US009277326B2

(12) United States Patent
Meng et al.

(10) Patent No.: US 9,277,326 B2
(45) Date of Patent: Mar. 1, 2016

(54) MINIATURE SPEAKER

(71) Applicants: Yiming Meng, Shenzhen (CN); Guqing Zhang, Shenzhen (CN)

(72) Inventors: Yiming Meng, Shenzhen (CN); Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/287,132

(22) Filed: May 26, 2014

(65) Prior Publication Data

US 2015/0163597 A1 Jun. 11, 2015

(30) Foreign Application Priority Data

Dec. 11, 2013 (CN) ..... 2013 2 0816232 U

(51) Int. Cl.
*H04R 1/00* (2006.01)
*H04R 9/02* (2006.01)

(52) U.S. Cl.
CPC ..... *H04R 9/025* (2013.01)

(58) Field of Classification Search
CPC ..... H04R 2307/207; H04R 2400/11; H04R 31/003
USPC ..... 381/396, 412, 115, 117, 190, 398, 411, 381/404, 386
See application file for complete search history.

(56) References Cited

U.S. PATENT DOCUMENTS 6,774,510 B1 * 8/2004 Moro ..... H04R 9/025 310/12.24
8,542,862 B2 * 9/2013 Meguro ..... H04R 7/045 381/396
2005/0220320 A1 * 10/2005 Kim ..... H04R 9/047 381/396
2011/0274308 A1 * 11/2011 Doh ..... H04R 9/06 381/398
2012/0170792 A1 * 7/2012 Li ..... H02K 33/16 381/412
2012/0177246 A1 * 7/2012 Shi et al. ..... 381/398

FOREIGN PATENT DOCUMENTS

EP 1365627 A1 * 11/2003 ..... B06B 1/045

* cited by examiner

*Primary Examiner* — Brian Ensey
*Assistant Examiner* — Julie X Dang
(74) *Attorney, Agent, or Firm* — IPro, Inc.; Na Xu

(57) ABSTRACT

A miniature speaker is disclosed. The miniature speaker includes a frame providing a receiving space, a magnetic circuit positioned in the receiving space and a vibration unit including a diaphragm and a voice coil driving the diaphragm. The magnetic circuit includes a main magnet positioned on a center of the lower plate, a pair of auxiliary magnets positioned spaced from the main magnet for forming a magnetic gap, a pole plate attaching to a top surface of the main magnet, and an upper plate. The upper plate includes a pair of main segments attached to top surfaces of the auxiliary magnets, and a pair of connecting beams connecting with the main segments and located between the two auxiliary magnets. The magnets are prevent from being attracted to each other by virtue of the upper plate.

10 Claims, 4 Drawing Sheets

MINIATURE SPEAKER

FIELD OF THE INVENTION

The present invention relates to electro-acoustic transducers, more particularly to a miniature speaker having an improved magnetic circuit.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

A magnetic circuit producing magnetic field for cooperating with an electrified voice coil to generate Lorenz Force is an important and necessary component in a miniature speaker. For obtaining sufficient driving force, i.e., the Lorenz Force, the miniature speaker generally includes multiple magnets. A miniature speaker related to the present disclosure includes a lower plate, a main magnet positioned on a center of the lower plate, and a pair of auxiliary magnets positioned away from two sides of the main magnet. A magnetic gap is accordingly formed between the main magnet and the auxiliary magnets. The magnets, including the main magnet and the auxiliary magnets, are all attached to the lower plate by adhesive, or soldering. When the magnets are magnetized, powerful attraction force is produced between the main magnet and the auxiliary magnets. Once the attraction force is greater than the adhesive force between the auxiliary magnet and the lower plate, the auxiliary magnets will be attracted to the main magnet, which makes the miniature speaker completely failed. Even if the auxiliary magnets are not attracted to the main magnet, the distance between the auxiliary magnets and the main magnet will be changed due to the movement of the auxiliary magnets. Change of the magnetic gap will badly affect the acoustic performance of the miniature speaker.

The present disclosure is accordingly provided to solve the problems mentioned above.

DETAILED DESCRIPTION OF THE EXEMPLARY EMBODIMENT

The present invention will hereinafter be described in detail with reference to an exemplary embodiment.

Figure 1:
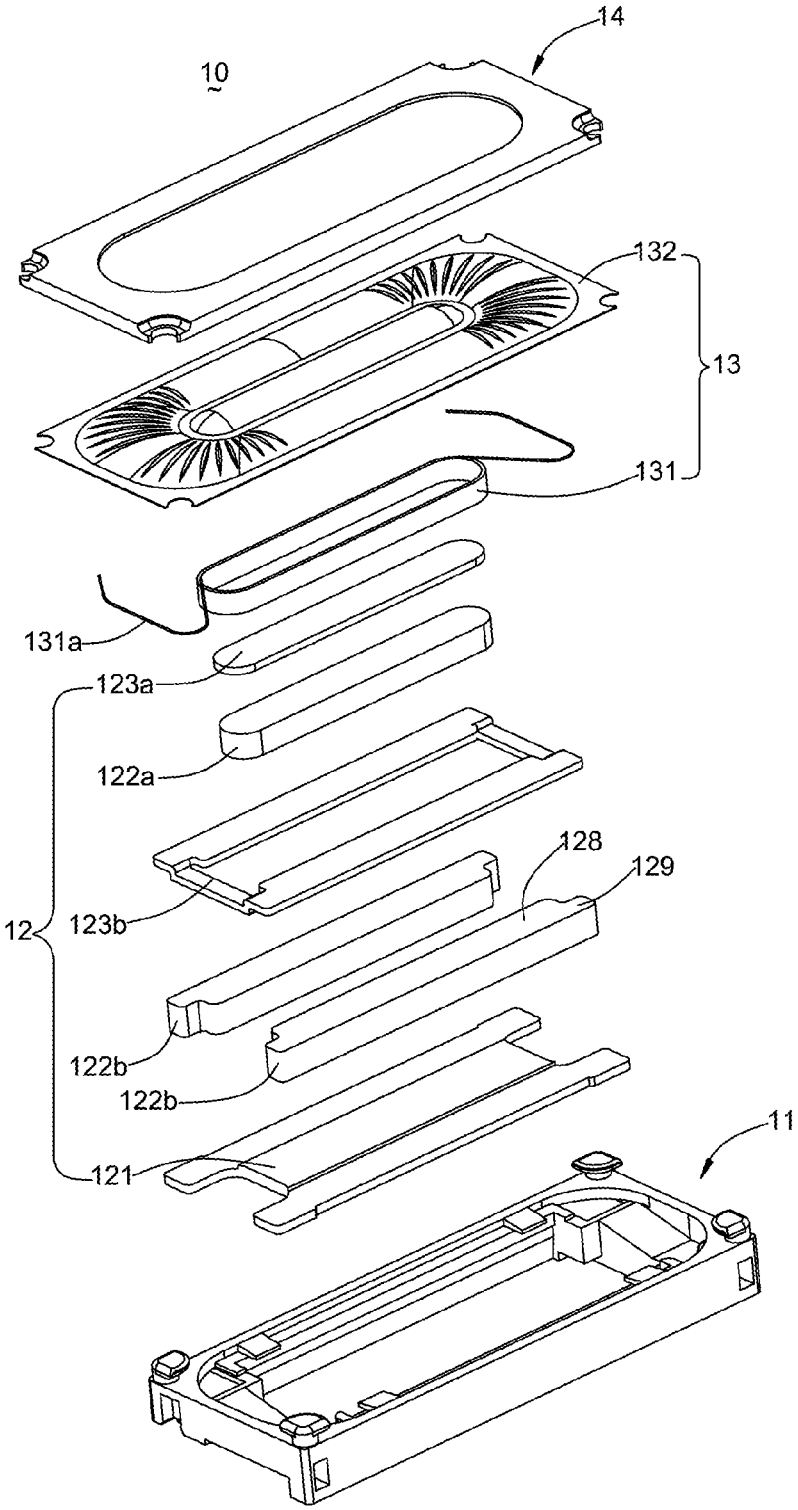
FIG. 1 is an isometric exploded view of a miniature speaker in accordance with an exemplary embodiment of the present invention.

Referring to FIG. 1, which is an isometric view of a miniature speaker in accordance with an embodiment of the present invention, the miniature speaker 10 includes a frame 11 providing a receiving space, a magnetic circuit 12 positioned by the frame 11, a vibration unit 13 fixed to the frame 11, and a cover 14 locating above the vibration unit 13.

The magnetic circuit 12 includes a lower plate 121, a main magnet 122*a* positioned on a central portion of the lower plate 121, a pair of auxiliary magnets 122*b* mounted on the lower plate 121 and spaced from two sides of the main magnet 122*a* for forming a magnetic gap 20 (referring to FIG. 2), a pole plate 123*a* attached to a top surface of the main magnet 122*a*, and an upper plate 123*b* attached to top surfaces of the auxiliary magnets 122*b*. Each of the auxiliary magnets 122*b* includes a main body 128 and a flange 129 extending from the main body 128. A step is accordingly formed by the main body 128 and the flange 129. The vibration unit 13 includes a voice coil 131 and a diaphragm 132 connected with the voice coil directly or indirectly. The voice coil 13 includes a voice coil 131 having lead wires 131*a*.

Figure 2:
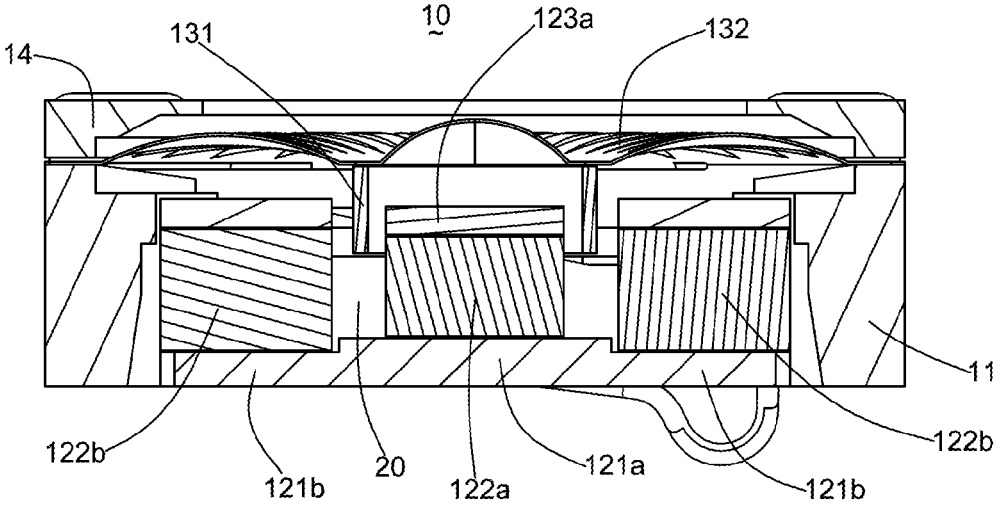
FIG. 2 is a cross-sectional view of the miniature speaker in FIG. 1.

Referring to FIG. 2, together with FIG. 1, when assembled, the magnetic circuit 12 accommodates in the frame 11, and the vibration unit 13 is fixed to the frame 11 with an edge of the diaphragm 132 pressed to the frame by the cover 14. The two auxiliary magnets 122*b* attaches to the lower plate 121, and the main magnet 122*a* attaches to the lower plate 121 and between the two auxiliary magnets 122*b*. In this embodiment, the lower plate 121 includes a protruding middle portion 121*a*, and two side portions 121*b* located beside the middle portion 121*a*. The main magnet 122*a* locates on the middle portion 121*a* of the lower plate 121, and the auxiliary magnets locate on the side portions 121*b* of the lower plate 121. By virtue of the configuration of the lower plate 121, the two auxiliary magnets 122*b* could be restricted in proper position. The pole plate 123*a* attaches to the top surface of the main magnet 122*a*. One end of the voice coil 131 connects to the diaphragm 132, and another end of the voice coil 131 suspends in the magnetic gap 20. When electrified, the voice coil 131 is driven to vibrate due to the alternating Lorenz Force generated by the magnetic field in the magnetic gap. The movement of the voice coil 131 activates the diaphragm 132 to vibrate, thereby producing sounds.

Figure 3:
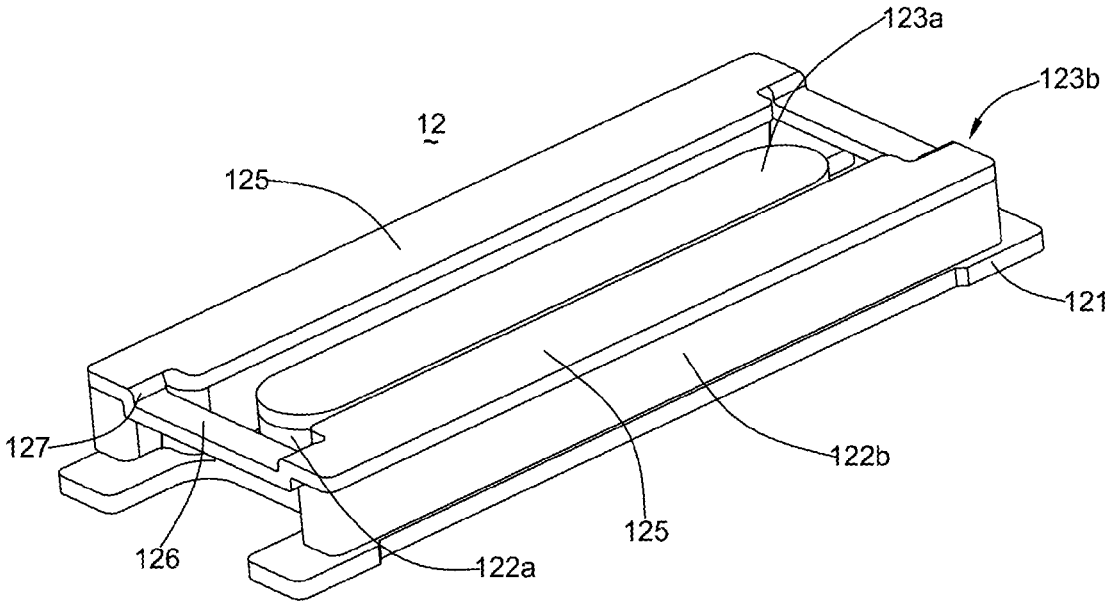
FIG. 3 is an isometric view of a magnetic circuit of the miniature speaker in FIG. 1.

Referring to FIG. 3, together with FIGS. 1-2, the magnetic circuit 12 is a multiple-magnet type. The two auxiliary magnets 122*b* are positioned on the side portions 121*b* of the lower plate 121, and the main magnet 122*a* is positioned on the middle portion 121*a* of the lower plate 121. The pole plate 123*a* attaches to the top surface of the main magnet 122*a*. The upper plate 123*b* is substantially ring-shaped, and includes a pair of main segments 125, a pair of connecting beams 126 spacing the two main segments 125, and butting portions 127 connecting the connecting beams 126 to the main segments 125. The two main segments 125 correspond to and attach to the two auxiliary magnets 122*b*. The two main segments serve as pole plates of the two auxiliary magnets 122*b*. The connecting beams 126 protrude toward the lower plate 121 relatively to the main segments 125. Thus an extra space 140 is accordingly formed by the connecting beam 126 and the butting portions 127.

Figure 4:
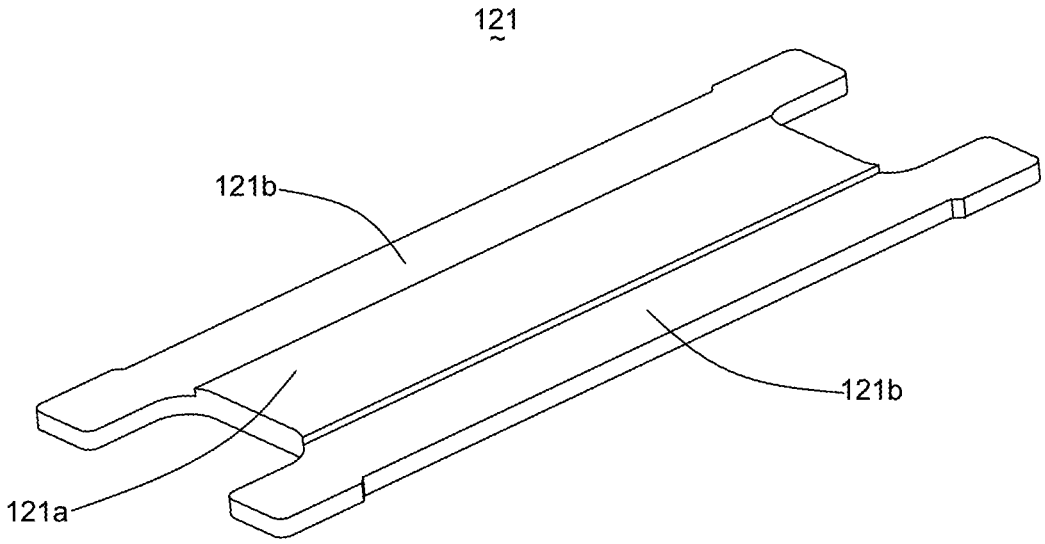
FIG. 4 is an isometric view of a lower plate of the magnetic circuit in FIG. 3.
Figure 5:
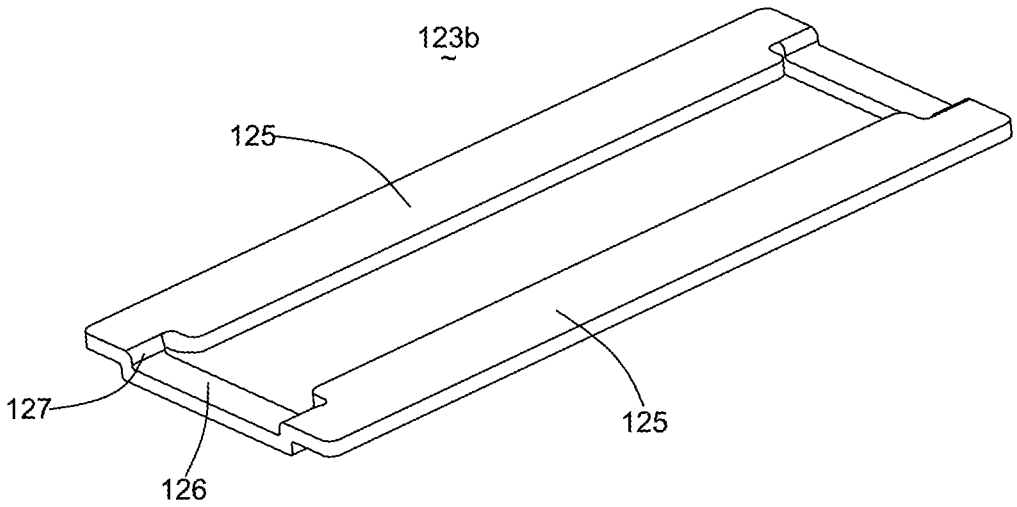
FIG. 5 is an isometric view of an upper plate of the magnetic circuit in FIG. 3.

FIG. 4 clearly illustrates the configuration of the lower plate 121. The lower plate 121 includes a thicker portion in a middle portion thereof and a thinner portion beside the thicker portion. The thicker portion serves as the middle portion 121*a*, and the thinner portion serves as the side portion 121*b*. FIG. 5 clearly illustrates the configuration of the upper plate 123*b*. The upper plate 123*b* is substantially a ring shape comprising two parallel main segments spaced from each other by connecting beams 126. The connecting beam 126 connects to the main segment 125 by the butting portions 127. The butting portions 127 and the connecting beam 126 form a depressed portion, i.e. the extra space 140.

Figure 6:
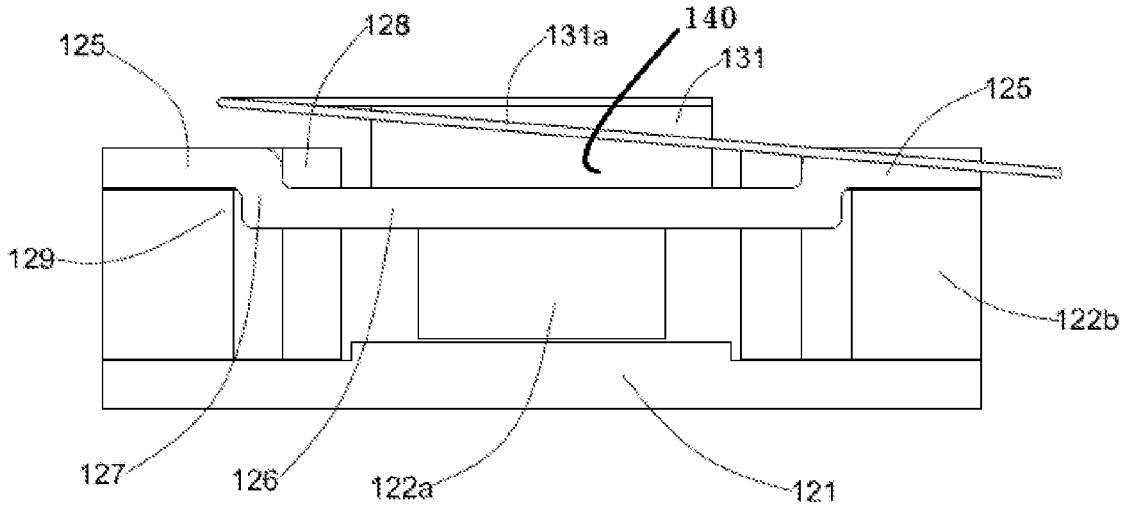
FIG. 6 is a lateral view of the magnetic circuit assembled with a voice coil of the miniature speaker.

Referring to FIG. 6, together with FIG. 3, when assembled, the auxiliary magnets 122*b* are sandwiched between the main segments 125 and the lower plate 121, and the connecting beam 126 positioned between the two auxiliary magnets 122*b*. The butting portion 127 abuts against the flange 129 of the auxiliary magnet 122*b*. By virtue of this configuration, the two auxiliary magnets 122*b* are spaced from each other by the connecting beam 126. Even if the attraction force between the main magnet 122*a* and the auxiliary magnets 122*b* is greater than the adhesive force between the auxiliary magnets and the lower plate 121, the two auxiliary magnets won't be attracted to the main magnet 122*a*, and the two auxiliary magnets 122*b* won't be moved by the attraction force, as the auxiliary magnets 122*b* are restricted in position by the engagement between the butting portion 127 and the flange 129 of the auxiliary magnet 122*b*. The extra space 140 formed by the butting portion 127 and the connecting beam 126 is capable of receiving a part of the lead wire 131*a* of the voice coil 131 for prevent the voice coil 131 from being conflicted with the magnetic circuit 12.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame providing a receiving space;

a magnetic circuit positioned in the receiving space, the magnetic circuit comprising a lower plate, a main magnet positioned on a center of the lower plate, a pair of auxiliary magnets positioned spaced from the main magnet for forming a magnetic gap, a pole plate attaching to a top surface of the main magnet, and an upper plate, the upper plate including a pair of main segments attached to a top surfaces of the auxiliary magnets and a pair of connecting beams connecting with the main segments by a butting portion and located between the two auxiliary magnets, the butting portion and the connecting beam cooperatively forming an extra space; and a vibration unit including a diaphragm and a voice coil driving the diaphragm, one end of the voice coil suspending in the magnetic gap, the voice coil further including a lead wire partially received the extra space for avoiding touched the upper plate.

2. The miniature speaker as described in claim 1 further including a cover pressing on an edge of the diaphragm for fixing the diaphragm.

3. The miniature speaker as described in claim 1, wherein the lower plate includes a protruding middle portion carrying the main magnet, and a side portion carrying the auxiliary magnets.

4. The miniature speaker as described in claim 1, wherein the lower plate includes a thicker portion carrying the main magnet, and a thinner portion carrying the auxiliary magnets.

5. The miniature speaker as described in claim 1, wherein the butting portion and the connecting beam cooperatively form a depressed portion toward the lower plate.

6. The miniature speaker as described in claim 5, wherein the auxiliary magnet includes a main body and a flange extending from the main body for forming a step abutting against the butting portion of the upper plate for restricting the position of the auxiliary magnet.

7. A miniature speaker, comprising:

a frame providing a receiving space;

a magnetic circuit positioned in the receiving space, the magnetic circuit comprising a lower plate, a main magnet positioned on a center of the lower plate, a pair of auxiliary magnets positioned spaced from two sides of the main magnet for forming a magnetic gap, a pole plate attaching to a top surface of the main magnet, and an upper plate; and a vibration unit including a diaphragm and a voice coil having a lead wire, one end of the voice coil suspending in the magnetic gap; wherein the upper plate includes two parallel first portions attaching to the auxiliary magnets and a pair of second portions spacing the first portion from each other, the second portions located between the auxiliary magnets, and the second portion being closer to the lower plate than the first portion for forming an extra space for partially receiving the lead wire of the voice coil.

8. The miniature speaker as described in claim 7, wherein the auxiliary magnet includes a main body and a flange abutting against the second portion of the upper plate.

9. The miniature speaker as described in claim 7, wherein the lower plate includes a protruding middle portion carrying the main magnet, and a side portion carrying the auxiliary magnets.

10. The miniature speaker as described in claim 7, wherein the lower plate includes a thicker portion carrying the main magnet, and a thinner portion carrying the auxiliary magnets.

* * * * *